United States Patent [19]

Tam et al.

[11] Patent Number: 4,971,249

[45] Date of Patent: Nov. 20, 1990

[54] AIRLESS SPRAY TIP RETAINER/DIFFUSER

[75] Inventors: Jimmy W. Tam, Shoreview; Sheila S. McKee, St. Paul, both of Minn.

[73] Assignee: Graco Inc., Minneapolis, Minn.

[21] Appl. No.: 417,019

[22] Filed: Oct. 4, 1989

[51] Int. Cl.[5] ..... B05B 15/02

[52] U.S. Cl. ..... 239/119; 239/288.3; 239/601

[58] Field of Search ..... 239/119, 288, 288.3, 239/288.5, 390–393, 590.3, 601

[56] References Cited

U.S. PATENT DOCUMENTS

| | | | |
|---|---|---|---|
| 442,762 | 12/1890 | Wainwright . | |
| 904,246 | 11/1908 | Buddington | 239/590.3 |
| 1,187,401 | 6/1916 | Thompson | 239/601 |
| 2,386,918 | 10/1945 | Timpson | 239/590.3 |
| 3,528,611 | 9/1970 | Watson | 239/119 |
| 3,593,920 | 7/1971 | Watson | 239/119 |
| 3,642,211 | 2/1972 | Place | 239/601 |
| 4,082,225 | 4/1978 | Haynes | 239/590.3 |
| 4,116,386 | 9/1978 | Calder | 239/119 |
| 4,165,836 | 8/1979 | Eull | 239/288 |
| 4,347,981 | 9/1982 | Hayes | 239/394 |
| 4,483,481 | 11/1984 | Calder | 239/119 |
| 4,484,707 | 11/1984 | Calder | 239/119 |
| 4,508,268 | 4/1985 | Gerberth, Jr. | 239/119 |
| 4,513,913 | 4/1985 | Smith | 239/119 |
| 4,537,355 | 8/1985 | Calder | 239/119 |
| 4,611,758 | 9/1986 | Gerberth, Jr. | 239/119 |
| 4,629,121 | 12/1986 | Hengesbach | 239/119 |
| 4,635,850 | 1/1987 | Leisi | 239/119 |
| 4,715,537 | 12/1987 | Calder | 239/119 |
| 4,757,947 | 7/1988 | Calder | 239/119 |

*Primary Examiner*—Andres Kashnikow
*Assistant Examiner*—Michael J. Forman

[57] ABSTRACT

The reversible spray tip assembly has a rotatable turret which may be reversed for cleaning and unclogging. The function of a diffuser is performed by a diffusing member which serves to retain the airless spray tip carbide within the rotatable member and which has an arc shaped aperture located off center and parallel to the circumference of the diametrical passage so as to in effect deflect the stream of fluid flowing through the tip sufficiently to prevent spraying of a coherent stream.

4 Claims, 1 Drawing Sheet

AIRLESS SPRAY TIP RETAINER/DIFFUSER

BACKGROUND OF THE INVENTION

Reversible spray tip assemblies for use in airless paint spraying are well known as typified by U.S. Pat. No. 4,165,836, the contents of which are hereby incorporated by reference. Such designs provide a diametrical passage in the rotatable member which serves to contain the spray tip member. At the opposite end of the diametrical passage, a diffuser member (which is typically a pin) is located diametrically across the diametrical passage (parallel to the longitudinal axis of the rotatable member.)

U.S. Pat. No. 4,116,386 discloses another manner of providing a diffuser by locating a second orifice member in the diametrical passage having a diameter and length effective to diffuse the liquid discharged therethrough and prevent exit of a coherent stream. Such a construction is quite dependent on the size of the orifice compared to the type and viscosity of liquid being sprayed therethrough.

It is therefore an object of this invention to provide a diffuser assembly which is effective in providing a diffusing function yet which is inexpensive to manufacture and is useable with a wide range of orifice sizes and a wide variety of fluids to be sprayed.

SUMMARY OF THE INVENTION

A generally conventional rotatable spray tip assembly has a rotatable member having a diametrical passage therethrough for retaining a spray tip member. The spray tip member is confined and retained in the diametrical passage by means of a second diffuser member which has an arc or crescent shaped passage therethrough. The passage is located adjacent to the circumference of the diametrical passage and is offset from the center line thereof, the orifice having an effective area larger than that which would otherwise serve to diffuse fluid sprayed therethrough. The diffuser can be threaded or pressed into the rotatable member or be a separate part held in place by a threaded or pressed-in retainer.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
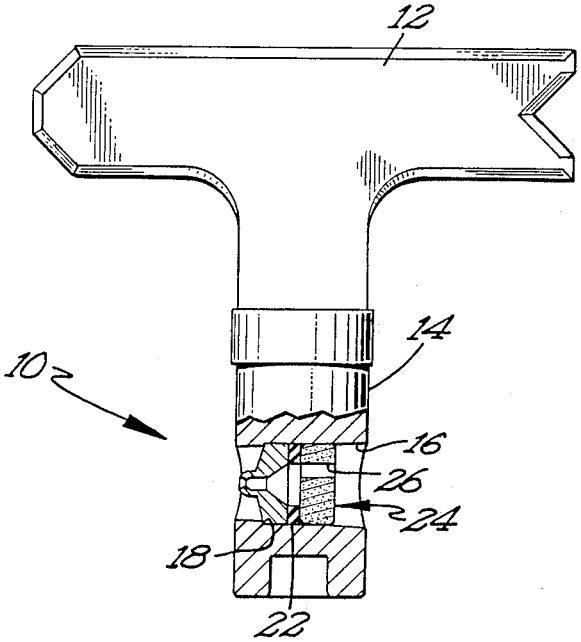
FIG. 1 is a partially cut-away view showing the rotatable tip assembly.

The reversible tip assembly of the instant invention, generally designated 10, is designed for use with a housing, tip guard and other associated parts of conventional design shown in the previously mentioned prior art patents. In particular, tip assembly 10 is comprised of a handle 12 and a cylindrical member 14 attached thereto. Cylindrical member 14 has a diametrical tip retaining passage 16 therethrough which is provided with a small step 18 for retaining spray tip member 20 thereagainst when inserted in passage 16.

Figure 2:
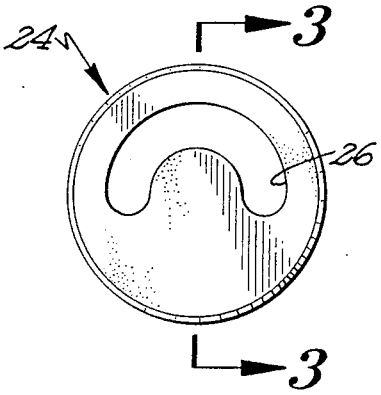
FIG. 2 is an end view of the diffuser member.
Figure 3:
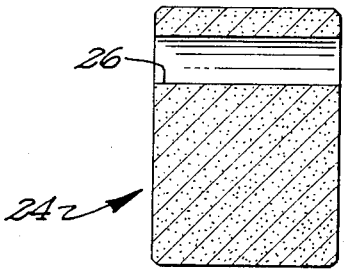
FIG. 3 is a sectional view taken along line 3—3 of FIG. 2.

A gasket member 22 is formed of a compatible plastic material or the like and placed behind spray tip 20 and is in turn held in place by diffuser member 24. Diffuser member 24 is held in place in diametrical passage 16 either by provision of a press fit as shown or by use of a threaded connection. Diffuser member 24 is shown in more detail in FIGS. 2 and 3 and is basically formed from a cylindrical part having an arc-shaped aperture 26 located therein. The diffuser member is preferably manufactured using the EDM process or by formation from a powdered metal material. Aperture 26 is located off-set from the center line of diffuser member 24 and located parallel to and adjacent the outer circumference **24*a* of diffuser member 24**.

The cross sectional area of arc shaped aperture 26 is such that it would not be sufficient to function as a diffuser were that same cross sectional area placed concentrically with the diffuser member. By substantially off-setting the opening from the center of the diffuser, effective diffuser functioning takes place while at the same time lessening the effect of the diffuser on the spray pattern which provides a more uniform spray pattern.

Additionally, fibrous materials are less likely to build up on the diffuser and clog the tip assembly while at the same time assembly of the diffuser into the cylindrical member is less susceptible to process variabilities than typical pin diffusers.

In the preferred embodiment, the outer curve of the arc has a radius of 0.089 inches and the inner side of the arc has a radius of 0.045 inches which is approximately the same as an equivalent simple circular orifice having a diameter of 0.070 inches. The thickness of the diffuser member in the preferred embodiment is 0.184 inches and such embodiment is effective as a diffuser with spray tip sizes up to 0.040 inch.

It is contemplated that various changes and modifications may be made to the reversible tip assembly without departing from the spirit and scope of the invention as defined by the following claims.

What is claimed is:

1. A reversible tip assembly for use in airless paint spray guns, said tip assembly comprising:

a cylindrical member having a diameter, a longitudinal axis and a tip retaining passage, said tip retaining passage having first and second ends, a longitudinal axis and being located across said diameter and generally perpendicular to said axis;

a spray tip member retained in said diametral passage adjacent said first end, said spray tip member having a paint spray passage substantially coaxial to said longitudinal axis of said tip retaining passage; and a diffuser member retained in said passage adjacent said second end, said diffuser member comprising a length in the direction of fluid flow and an aperture located in an offset position relative to said longitudinal axis of said tip retaining passage and said paint spray passage over substantially all of said length, said diffuser member being entirely located within said passage said aperture being of such shape and location as to disrupt the flow of fluid therethrough so as to prevent a coherent stream when said member is reversed for cleaning and where said aperture has a size sufficient to allow spraying of a coherent stream if placed coaxially in a fluid stream.

2. The reversible tip assembly of claim 1 wherein said aperture is generally arc shaped and located parallel and adjacent to the said passage.

3. The reversible tip assembly of claim 1 wherein said diffuser member is pressed into said cylindrical member.

4. The reversible tip assembly of claim 1 wherein said diffuser member is retained in said cylindrical member by a pressed-in retainer member.

* * * * *